US005078333A

United States Patent [19]

Hester

[11] Patent Number: 5,078,333

[45] Date of Patent: Jan. 7, 1992

[54] COUNTERTRIANGULAR OPTICAL POSITION SENSOR

[75] Inventor: Troy L. Hester, Huntsville, Ala.

[73] Assignee: The United States of America as represented by the Secretary of the Army, Washington, D.C.

[21] Appl. No.: 607,346

[22] Filed: Oct. 29, 1990

[51] Int. Cl.[5] ..... B65H 54/28

[52] U.S. Cl. ..... 242/158 R; 242/25 R; 250/548; 250/571

[58] Field of Search ..... 242/158 R, 158 A, 158 B, 242/158 F, 158.2, 158.4 R, 158.4 A, 25 R; 226/20, 21; 250/548, 561, 571

[56] References Cited

U.S. PATENT DOCUMENTS

| | | | |
|---|---|---|---|
| 3,039,707 | 6/1962 | Beck et al. | 242/158.2 X |
| 4,535,955 | 8/1985 | Custer | 242/158 R |
| 4,655,410 | 4/1987 | Ruffin et al. | 242/158 R |
| 4,838,500 | 6/1989 | Graham | 242/158 R |
| 4,928,904 | 5/1990 | Watts | 242/158 R |
| 5,009,373 | 4/1991 | Hester | 242/158 R |

*Primary Examiner*—Stanley N. Gilreath
*Attorney, Agent, or Firm*—Freddie M. Bush; Howard G. Garner

[57] ABSTRACT

An optical position sensor for a winding apparatus for winding an optical filament onto a rotating bobbin having means for controlling the winding angle of the filament. The invention comprises a winding angle sensor surface which is rectangular and divided into two surfaces by a diagonal line extending across the path of the filament being wound. The invention includes computer means for receiving signals from each of the halves of the sensor surface for calculating the position of the shadow of the filament crossing over the sensor surface. the sensor head includes means for generating light uniformly on the opposite side of the said filament from said sensor surface.

12 Claims, 2 Drawing Sheets

COUNTERTRIANGULAR OPTICAL POSITION SENSOR

The invention described herein may be manufactured, used, and licensed by or for the Government for governmental purposes without the payment to me of any royalties thereon.

BACKGROUND OF THE INVENTION

This inventions relates to an optical position sensor for apparatus for controlling the winding angle for winding optical filaments onto a bobbin.

More particularly, this invention relates to a countertriangular optical position sensing device for sensing the angle at which optical filament is being wound on the bobbin and for controlling the winding Mechanism and traversing device for maintaining the winding angle at the desired winding angle.

It is known to sense the winding angle at which a filament or yarn is being wound onto a bobbin by using a moveable element or guide through which the yarn or filament passes. Lateral movement of the filament causes the guide to move and the angle in which the filament or yarn is being wound onto the bobbin is sensed, within limits, by the position of the guide element. Such a system has a disadvantage of being inaccurate since the opening in the guide is always larger than the diameter of filament or yarn so that the winding angle may vary without causing the element to indicate the variation. Furthermore, physical contact with the guide or sensing element may tend to damage the filament, especially when delicate fiberoptic glass filaments are concerned.

One process and apparatus for controlling the angle at which the filament is wound onto the bobbin without physical contact with the filament is found in U.S. Pat. No. 4,838,500, issued June 13, 1989 to Gregory S. Graham for "Process and Apparatus for Controlling Winding Angle". This patent discloses a process and apparatus wherein the filament passes through a guide and over an array of light sensing elements arranged in a row, and positioned on centers substantially equivalent to the diameter of the filament. Collimated light is projected onto the array so as to cast a shadow of the filament on one of the light sensing elements in the array. Beams are provided for detecting the particular element on which the shadow of filament falls and for traversing the bobbin at a rate which will maintain the shadow of the filament on the particular light sensing element on which the shadow will fall when the winding angle is at the selected or desired value.

The device in U.S. Pat. No. 4,838,500 is a great improvement over the mechanical devices described above. However, it requires a number of sensors which greatly increases the expense of the apparatus, and the complexity of the multi-cell array, the minimum resolution governed by the size of the array, and the digital output of the array itself are disadvantages. The digital output of the array does not lend itself to use in analog systems.

SUMMARY OF THE INVENTION

It is the object of the present invention to provide an optical position sensor for apparatus for winding and controlling the winding angle at which a filament is wound onto a rotating bobbin. This device comprises a photosensitive surface which is rectangular but divided by a diagonal separation so that the rectangular area actually comprises the two separate and distinct triangular photosensitive surfaces. This device allows the generation of an analog signal which is proportional to the lateral position of a shadow cast by an optical filament traversing its sensing surface. This device is unique in that its output is an analog voltage which simplifies its integration into an analog position control system. Its output is proportional to the position of the shadow rather than a light spot along the photosensitive surfaces.

It is therefore an object of the invention to provide an optical position sensor for an apparatus for winding and controlling the winding angle at which the filaments are wound onto a rotating bobbin.

It is a further object of the invention to provide an optical position sensor for an apparatus for winding and controlling the winding angle at which a filament is wound onto a rotating bobbin by generating an analog signal which is proportional to the position or the angle at which the filament is being wound onto the bobbin.

These and other objects which will become obvious are obtained by the invention illustrated herein and described below in more detail.

DETAILED DESCRIPTION OF THE INVENTION

Figure 1:
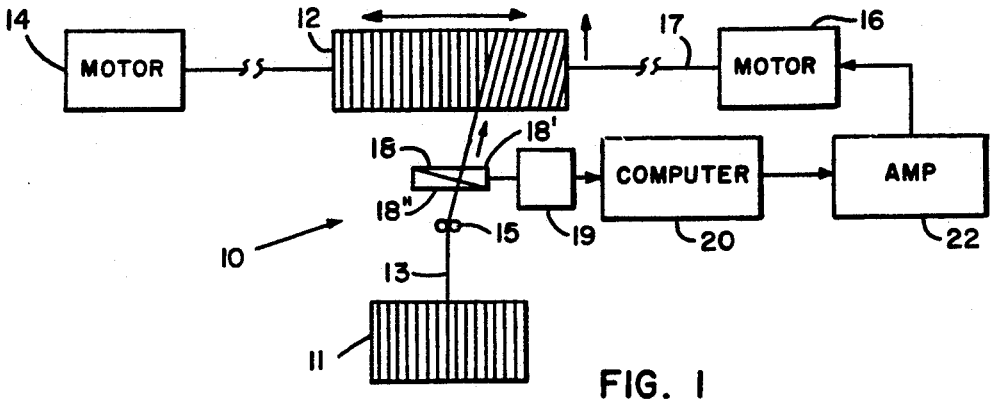
FIG. 1 is schematic plan view of the winding apparatus with the position sensor of the invention.
Figure 2:
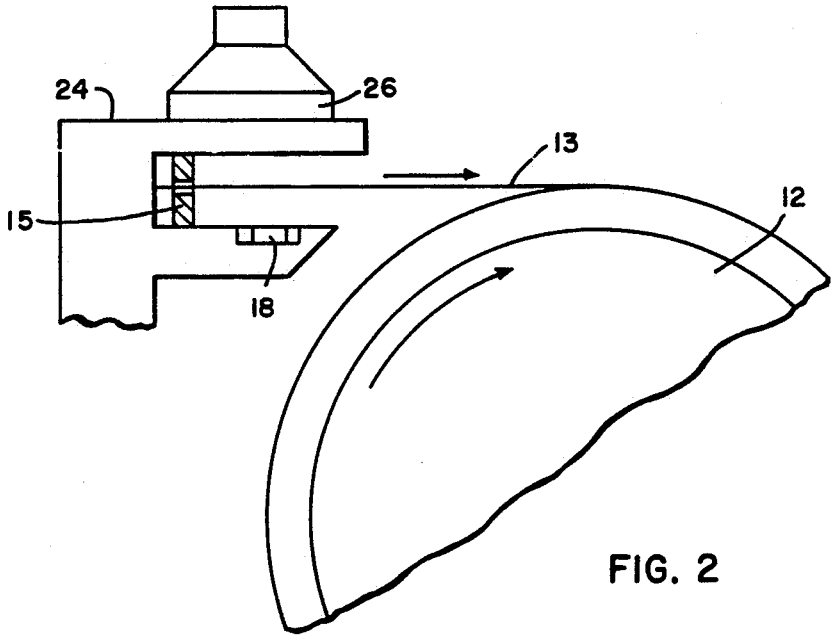
FIG. 2 is a side view of the apparatus illustrated in FIG. 1, showing details of the optical position sensor.
Figure 3:
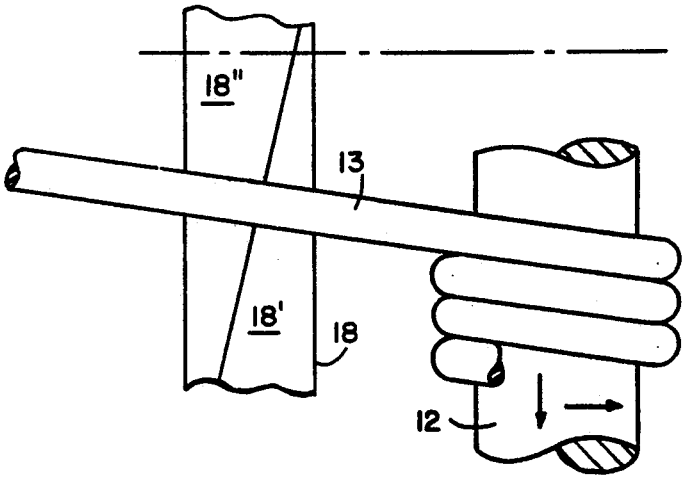
FIG. 3 is a greatly enlarged fragmentary view showing the manner in which the winding apparatus will wind a filament onto a bobbin with little or no space between adjacent turns of the optical filament in a given filament layer.

Referring now to FIGS. 1, 2, and 3 of the drawings wherein the filament winding apparatus 10 is illustrated. The filament winding apparatus 10 comprises a filament supply 11 for suppling a filament 13 which is wound onto a bobbin 12. Interposed between supply 11 and bobbin 12 is a fixed position guide 15 and an optical position sensor 18 which is rectangular and comprises two triangular sections 18' and 18''.

Bobbin 12 is rotated by a drive motor 14 and is traversed by traversing motor 16 which drives a traversing screw. The winding angle of the filament onto bobbin 12 is controlled by controlling the rotation of traversing motor 16 and drive motor 14 for bobbin 12.

The signals generated by optical position sensor 18 are transmitted to an analog-to-digital converter 19, and then to a position computer 20, and which transmits a control signal to an amplifier 22, which, in turn, transmits the amplified signals to traversing motor 16 which then controls the traversing movement of bobbin 12 to maintain the desired winding angle as sensed by the optical position sensor 18.

As seen best in FIG. 2, the optical position sensor 18 is mounted on a scanner head 24. Also mounted on scanner head 24 is a stationary yarn guide 15 and light source 26. Light source 26 is positioned opposite sensor 18 so that when a filament 13 is drawn through stationary guide 15 enroute to being wound on bobbin 12, light transmitted by light source 26 will cast a shadow onto the optical sensor 18.

Figure 6:
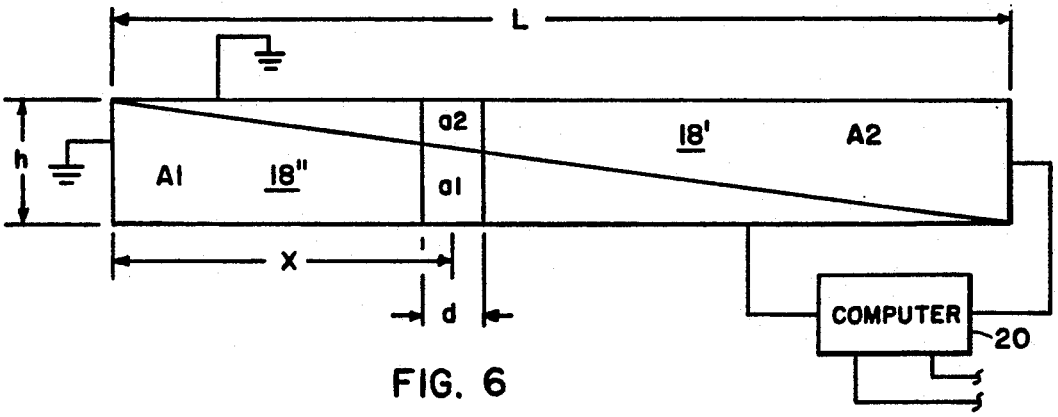
FIG. 6 is a schematic plan view of the optical position sensor and its wiring diagram.

FIG. 3 illustrates the process of the invention. When filament 13 is being wound onto bobbin 12 at the desired winding angle, with no gaps between the adjacent turns of the filament on bobbin 12, the shadow of the filament will fall over predetermined area of optical sensor 18. The computer 20 receives separate signals from triangles 18' and 18'' (as best seen in FIG. 6) and compares the values of the currents generated by the photodiode surfaces of the triangular sections 18' and 18'' for generating an analog electrical signal in response to light impinging thereon. Triangular components 18' and 18'' are electrically insulated from each other and are mirror images of each other. Light source 26 is spaced from the two component diode surface for illuminating uniformly the surfaces. Guide means 15 guides the filament between the light source and the two component photodiode surfaces as it is being wound onto the bobbin. The signals generated by the photodiode surface correspond to the volume and the position of the filament as it passes between the light source and the surfaces while it is being wound onto bobbin 12. The signals generated by photodiode surfaces 18' and 18'' are received by computer 20 which compares the two signals and calculates the angular position of the filament as it is being wound onto the bobbin. If the position calculated differs from the desired position previously programmed into the computer the computer generates control signals to control the traversing of the bobbin and the rotational rates to wind the filament onto the bobbin at the desired predetermined winding angle.

Figure 4:
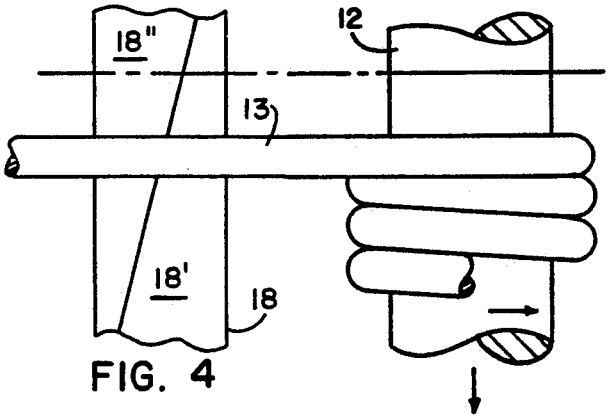
FIG. 4 is a greatly enlarged fragmentary view showing the manner in which the turns of the filaments will tend to overlap when the bobbin is not traversed past the filament guide at a sufficiently high rate of speed.

FIG. 4 illustrates the result when bobbin 12 is traversed at a rate less than the desired rate. In this case, filament 13 tends to overlap adjacent turns in the layer being formed. Furthermore, the shadow of filament 13 will not fall on the particular surfaces of the photodiode triangular surfaces 18' and 18'' but will fall so as to give a different value than the desired signals. The generated signals are compared in the computer 20. When computer 20 measures or detects a value different than that indicating the predetermined correct angle it generates a signal for the amplifier 22 to increase the rate of traverse of bobbin 12 so as to provide the predetermined winding angle (as shown in FIG. 3).

Figure 5:
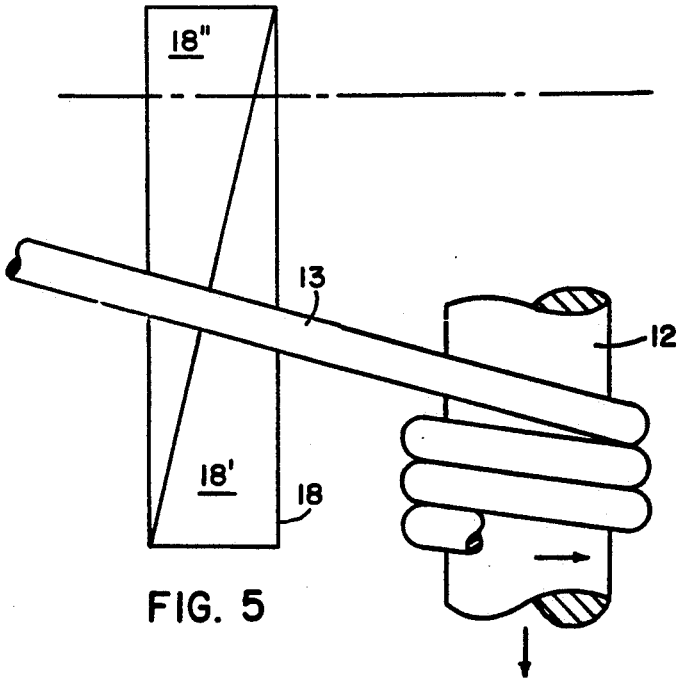
FIG. 5 is an enlarged fragmentary view showing the manner in which the turns of the filament will be wound onto the bobbin when the bobbin is traversed past the filament guide at a rate is too great.

FIG. 5 illustrates the result of traversing bobbin 12 at a rate which is too fast. In this case a gap is formed in between the turns of the filaments being wound onto the bobbin. The shadow of filament 13 will fall onto triangular surfaces 18' and 18'' so that a signal variation will be transmitted to computer 20. The computer will sense the signal differential and generate a signal for amplifier 22 which will decrease the rate of traverse of bobbin 12 to reduce the winding angle into conformance with that shown in FIG. 3.

Referring now to the FIG. 6, the following example is given to illustrate the use of the apparatus of the invention and its operation.

EXAMPLE

Assume that a filament is suspended above the optical position sensor, perpendicular to its length so that its shadow falls across both triangular surfaces 18' and 18''.

For a uniform illumination of photosensitive element 18 the currents generated by the optical position sensor are:

$$I1 = K1\,(A1 - a1)$$

$$I2 = K2\,(A2 - a2)$$

The major areas of the position sensor 18, A1 and A2, are constant. The minor areas, a1 and a2, vary with the filament's position, x, along the length L of the optical position sensor.

$$a1 = dh(1 - (x/L))$$

$$a2 = dh(x/L)$$

The needed signal can be derived by subtracting the two currents.

$$\begin{aligned} Is &= I2 - I1 \\ &= K2\,(A2 - a2) - K1\,(A1 - a1) \end{aligned}$$

Assume the scale factors, K1 and K2, are identical.

$$\begin{aligned} K1 &= K2 - K \\ Is &= K[(A2 - a2) - (A1 - a1)] \\ &= K(A2 - a2 - A1 + a1) \end{aligned}$$

Assume the areas, A1 and A2 are identical.

$$\begin{aligned} A1 &= A2 = A \\ Is &= K(A - a2 - A + a1) \\ &= K\,(a1 - a2) \\ &= K[dh(1 - (x/L)) - dhx/L] \\ &= Kdh\,[1 - (x/L) - (x/L)] \\ Is &= Kdh(1 - 2x/L) \end{aligned}$$

Therefore, the output signal, Is, is a linear function of x, the position of the filament along the length of the optical sensor 18.

In the above Example the terms used therein have the following meanings:

Triangular areas A1 and A2: These are the photodiode surfaces 18' and 18'' whose current output is proportional to the amount of light falling on their surfaces.

I1 and I2 are respective currents generated by the respective photosensitive surfaces A1 and A2.

K1 and K2 are gain factors associated with the respective photodiode surfaces.

a1 and a2 are the areas on the respective photodiode surfaces that are shaded by the shadow of the filament.

Is is the difference in current generated between the elements 18' and 18''.

h is the width of total photosensitive area of the optical position sensor 18.

L is the total length of the photosensitive area of the optical position sensor 18.

x is the distance from the reference end of the photosensitive area to the center of the filament.

d is the width of the shadow cast by the filament onto the photosensitive surfaces of optical position sensor 18.

The above computations are calculated automatically by the computer 20 to generate output control signals for controlling traversing motor 16. It can be readily seen that the apparatus of the invention can be used to precisely control the angle at which the filament is wound onto the bobbin. In some cases it may be desirable to wind the bobbin in such a manner that there is a small space left between the adjacent turns of the filament in a given area of wound bobbin. In this case, computer 20 can be programmed to vary the output of the optical position sensor to the traversing motor in accordance with the predetermined spacing of the filament turns on the bobbin.

It is to be understood that in the operation of the apparatus of the invention the entire rectangular surface of the position sensor 18 is uniformly illuminated so that the two individual triangular sensor elements 18' and 18'' produce identical analog outputs in the absence of a shadow. As the shadow of a filament is cast across the width of the rectangular position sensor, the shaded area under the filament for each of the triangular elements 18' and 18'' varies with the position of the filament along the length of the optical sensor. As the shaded area of one of the triangular elements 18' and 18'' increases, the shaded area of the other triangular element decreases and vice versa. Therefore, the difference between the output of the two triangular sensing elements 18' and 18'' is a function of the position of the filament shadow along the length of the sensing device.

While the above example shows the position sensor of the invention in use on winding apparatus to detect the winding angle of a filament being wound onto a spool it is to be understood that the sensor of the invention may be used wherever it is necessary to measure the position of a body, filament, yarn, or the like as it moves past a given point. For example, the position sensor of the invention can be used in applicant's patented active lag angle device, disclosed in applicant's U.S. Pat. No. 4,953,804, issued Sept. 4, 1990, to replace the position sensor in that device. U.S. Pat. No. 4,953,804 is hereby incorporated herein, by reference.

It is to be understood that the embodiments illustrated and described herein are given only by way of example and that the invention is limited only by the scope of the appended claims.

I claim:

1. Optical position sensing apparatus for sensing the position of a moving body as it passes a fixed point, comprising:

a) a two-component photodiode surface disposed at said fixed point for generating an electrical signal in response to light impinging thereon, each of said components being electrically insulated from each other;

b) a light emitting source spaced from said two-component photodiode surface for uniformly illuminating said surface;

c) guide means for guiding said moving body between said light emitting source and said two-component photodiode surface in a position to cast a shadow onto each component of said photodiode surface corresponding to the volume and position of said body; and d) means for receiving electrical signals generated by each of said photodiode components for comparing said signals and producing a signal indicative of the position of said moving body.

2. Apparatus as set forth in claim 1, wherein said moving body is a running strand.

3. Apparatus as set forth in claim 1, wherein an analog to digital converter is operatively interposed between said two-component photodiode surface and said receiving means.

4. Apparatus as set forth in claim 1, wherein said two-component photodiode surface is rectangular.

5. Apparatus as set forth in claim 1, wherein said photodiode surface is divided into two components by a line which is diagonal to the longitudinal axis of said moving body at said fixed point.

6. Apparatus as set forth in claim 1, wherein said two components of said photodiode surface are mirror images of each other.

7. Apparatus as set forth in claim 1, wherein said photodiode surface is rectangular and is composed of two equal and opposite triangular surfaces.

8. Winding apparatus for winding an optical filament onto a rotating bobbin, having means for controlling the winding angle of said filament, comprising:

(a) a bobbin;

(b) means for supporting said bobbin for rotation and for traversal along its longitudinal axis;

(c) means for rotating said bobbin at a constant rate of rotation about its longitudinal axis;

(d) means for traversing said bobbin along its longitudinal axis at a variable rate;

(e) means for supplying an optical filament to said bobbin spaced a distance therefrom;

(f) an optical position sensor for sensing the angular position of said optical filament as it is wound onto said bobbin, disposed between said supply means and said bobbin, comprising:

(1) a two-component photodiode surface for generating an electrical signal in response to light impinging thereon, each of said components being electrically insulated from each other;

(2) a light source spaced from said two-component photodiode surface for uniformly illuminating said surface; and (3) guide means for guiding said filament between said light source and said two-component photodiode surface as it is being wound onto said bobbin in a position to cast a shadow onto each component of said photodiode surface corresponding to the volume and the position of said filament;

(g) computer means for receiving signals generated by each component of said photodiode surface and for comparing said signals and calculating the angular position of said filament as it is wound onto bobbin, and for generating control signals for said traversing means to control the traversal rate of said bobbin to wind said filament thereon at a predetermined winding angle.

9. Winding apparatus as set forth in claim 8, wherein said two components photodiode surface is rectangular.

10. Winding apparatus as set forth in claim 9, wherein said photodiode surface is divided into two components by a line which is diagonal to the longitudinal axis of said filament.

11. Winding apparatus as set forth in claim 8, wherein said two components of said photodiode surface are mirror images of each other.

12. Winding apparatus as set forth in claim 8, wherein said two-component photodiode surface is rectangular and is composed of two equal and opposite triangular surfaces.

* * * * *